United States Patent [19]

Arai

[11] Patent Number: 4,707,945

[45] Date of Patent: Nov. 24, 1987

[54] UPPER PLATE DRIVING SYSTEM FOR SURFACE LAPPING MACHINE

[76] Inventor: Hatsuyuki Arai, #2-5307-2, Komatsubara, Zama-City, Kanagawa-Prefecture, Japan, 228

[21] Appl. No.: 876,690

[22] Filed: Jun. 20, 1986

[30] Foreign Application Priority Data

Jul. 5, 1985 [JP] Japan ..... 60-102530[U]

[51] Int. Cl.[4] ..... B24B 7/00

[52] U.S. Cl. ..... 51/118; 51/131.4; 403/359

[58] Field of Search ..... 51/118, 131.1, 131.2, 51/131.3, 131.4; 403/359; 192/28, 26

[56] References Cited

U.S. PATENT DOCUMENTS

| | | | |
|---|---|---|---|
| 3,290,918 | 12/1966 | Weasler | 403/359 |
| 4,157,637 | 6/1979 | Orlov et al. | 51/118 |
| 4,392,759 | 7/1983 | Cook | 403/359 |
| 4,433,510 | 2/1984 | Katagiri et al. | 51/118 |

*Primary Examiner*—Frederick R. Schmidt
*Assistant Examiner*—Robert A. Rose
*Attorney, Agent, or Firm*—Charles F. Pigott, Jr.

[57] ABSTRACT

An upper plate driving system is employed on a surface lapping machine. By this invention, poor performance and work-piece breakage can be avoided by providing a smooth connection between the upper plate and lower plate during operation. The driving system includes a cylindrical driver vertically mounted on typically the lower plate, the driver having a plurality of driver slots defined around its periphery at regular intervals and defining outer ends that flare outwardly to receive a corresponding plurality of lock arms mounted on the upper plate. Thus the upper plate can be raised and lowered into and out of connection wtih the driver slots of the driver member. By this invention, the lock arms are defined into two groups. Each lock arm is spaced from other lock arms in its group at a phase angle which is an even multiple of the spacing of adjacent driver slots. The rotational spacing between each of the two groups of lock arms is a similar even multiple of driver slot spacings, plus one-half of a pitch angle, such pitch angle equalling the center-to-center spacing of adjacent driver slots.

5 Claims, 4 Drawing Figures

UPPER PLATE DRIVING SYSTEM FOR SURFACE LAPPING MACHINE

BACKGROUND OF THE INVENTION

This invention relates generally to an improved system for operating of an upper plate driver on a surface lapping machine. More particularly, it relates to a system for connecting a plurality of driver slots with a plurality of upper plate locks, so as to provide locking connection between a driver member and an upper plate is an engaging position, but permitting the upper plate to be raised out of contact with the driver slot for access to the workpieces being lapped within the machine.

In conventional surface lapping machines, workpieces are held in carriers between upper and lower plates for grinding, lapping action. Typically, a driver is provided having a plurality of driver slots extending in evenly spaced manner about the driver, which is generally at the end of a shaft connected to a power source. The upper plate defines a plurality of locks such as rollers which may slide into the slots as the upper plate closes into operating position, to be driven in the operation. The upper plate may also be raised out of contact with the driver in the open position.

Accordingly, there is a problem when an upper plate is being closed into the operating position of getting the proper alignment of the driver slots on the driver and the locks on the upper plate. Typically, in a conventional machine one must manually rotate the upper plate to align these members. Alternatively, one drops the upper plate and then starts the rotation of the driver, causing the locks to suddenly fall into slots. However, when this is done, a sudden shock is imparted to the machine as the upper plate suddenly begins rotating. This shock can damage the workpieces as well as the machine. Accordingly, poor maintenance and performance may result, plus breakage and other damage to the workpiece.

Japanese Patent No. 59-132755, issued Sept. 5, 1984, discloses an improved system for easily connecting the upper plate to the drive member, involving a plurality of driver slots which flare uniformly outwardly at their top along the circumference to their driver member to reduce the difficulty of causing the upper plate locks to find the engaged driver slots. A plurality of slot guides are formed taperingly and positioned adjacent the driver slots, to define the slots.

While such an improved system may avoid some of the problems noted above, when compared with standard prior art for plate driving systems, the system has another problem as follows: if the upper plate locks descend directly onto the center of the slot guides, they will be out of position on the slot guide relative to the slots. Accordingly, as the driver rotates, at the moment of grabbing of the upper plate into rotation with the driver, tremendous shock to the workpieces may result. If the upper plate locks are secured without tension springs, the locks will hit hard upon the slot guide top centers in descending, to cause the tremendous shock. This can stop operation of the upper plate by damaging it.

By the invention of this application, the above problems are advantageously solved, for improved performance of lapping machinery.

SUMMARY OF INVENTION

It is an object of this invention to provide a novel, smooth connecting method which will obviate or minimize disadvantages and deficiencies of the type previously described.

In view of the prior art described above, one object of the invention is to connect firmly locks with slots at any rotational position of a descending upper plate. A second object of the invention is to prevent shock, and to lock smoothly in connecting.

An advantage of the present invention is that it provides a means of connecting an upper plate with a lower plate for a surface lapping machine by a simply designed system without added connecting members. Briefly, the new concept is to keep a relational position between upper drive lock arms and driver slots in conjunction with prior art systems.

The above and other objects, features and advantages of the invention will become more apparent from the following description.

In accordance with this invention, an upper plate driving system for a surface lapping machine is provided having an upper plate and a lower plate, a generally cylindrical driver vertically mounted in a center section of said lower plate, a plurality of driver slots extending longitudinally around said driver in uniform manner, and a plurality of lock arms mounted on the upper plate and removably engagable with the driver slots. Alternatively, as an equivalent structure, the lock arms could be positioned on the driver, while the driver slots are appropriately positioned on the upper plate.

In accordance with this invention, the lock arms define at least two groups. The lock arms of each group are positioned at a phase angle to each other about the driver which is equal to the angular spacing of each driver slot times a whole number, the whole number being typically from 1–10. The lock arms of each group are spaced from the lock arms of the other group by a phase angle which is equal to the same angular spacing of adjacent driver slots, times a whole number (also typically 1–10), minus one-half of a pitch, a pitch being defined as the distance between the center of a driver slot and that of an adjacent driver slot. Accordingly, the lock arms of different groups may be said to be 180 degrees out of phase with each other. When the lock arms of one group are capable of engaging slots, the lock arms of the other group are positioned to engage the wall area between said slots.

Such a structure can automatically cause the upper plate to automatically enter into engagement with the slots with less shock and sudden rotation, because lock arms are present to enter such slots at substantially all relative rotational positions of the driver and upper plate.

Preferably, the slots are outwardly flared at their outer ends, where they initially enter into engagement with the lock arms, to further facilitate easy engagement between the driver and upper plate.

DESCRIPTION OF SPECIFIC EMBODIMENT

Before proceeding to describe the invention, the operation and system of a prior art will be briefly described. For a further description of the driver system commonly known as an upper plate driving system, reference may be made to Japan Patent No. 59-132755, issued Sept. 5, 1984.

Figure 4:
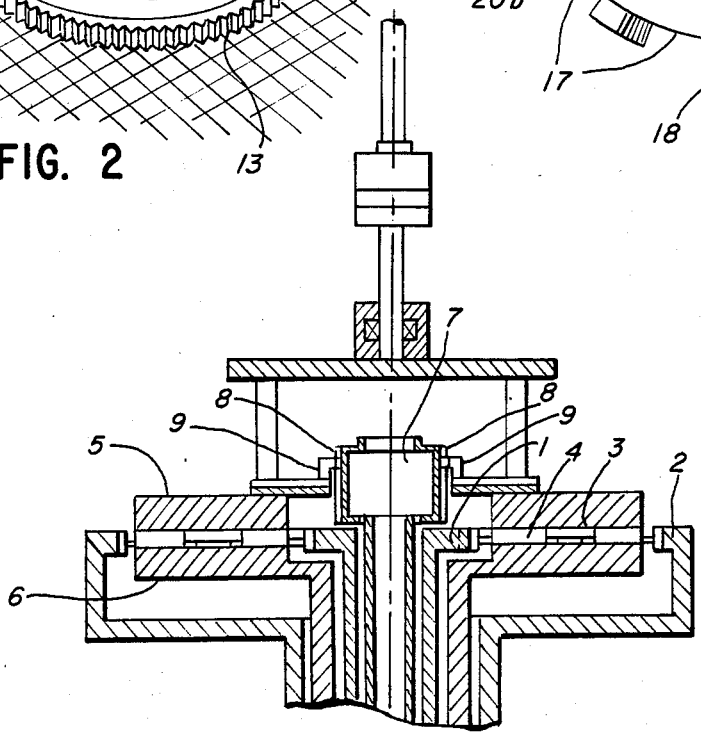
FIG. 4 PRIOR ART
FIG. 4 is a longitudinal sectional view of a standard surface lapping machine of the prior art.

As shown in FIG. 4, a well-known, conventional surface lapping machine laps several workpieces 3 held in several carriers 4 which are meshed with a sungear 1 and a ring gear 2, and in contact with both upper plate 5 and lower plate 6. In the aforementioned machine, a cylindrical driver 7 in a center position of the grinding section is employed in order to drive the upper plate 5.

Precisely speaking, a plurality of driver slots 8 mounted on the driver 7 circumferentially from top to bottom are engaged with a plurality of upper plate locks 9, such as rollers and the like, mounted on upper plate 5. Thus upper plate 5 is locked into rotation with driver 7 which may be energized by a motor.

When the upper plate 5 is lowered from an upper position after loading (or unloading) the carriers 3 and workpieces 4 to the illustrated position for lapping, the locks 9 will not be above the driver slots 8 in many cases, thus requiring the manual rotation of the upper plate, or the starting of machine operation in order to rotate the driver slots 8 into a position in conjunction with the locks 9. This will make the automatic operation of the machine difficult.

The upper plate locks 9 are mounted on upper plate 5 rotatably within a flat surface including the axis of the driver 7 and directed toward the driver 7 by springs. For this reason, when the upper plate 5 is lowered in a condition that the locks 9 are not above the driver slots 8, and the driver 7 is energized to drive, the locks 9 slip on the side of the driver 7 until they snap into driver slots 8. At this moment, the upper plate driver 7 rotates in a direction relatively opposite to the lower plate, (i.e. at a different rotational rate) due to the difference of the rotational speed between the lower plate 6 and the upper plate 5. This sudden, differential rotation of the upper plate 5 will transmit a tremendous shock to the workpieces 4, when locks 9 snap into driver slots 8.

Figure 1:
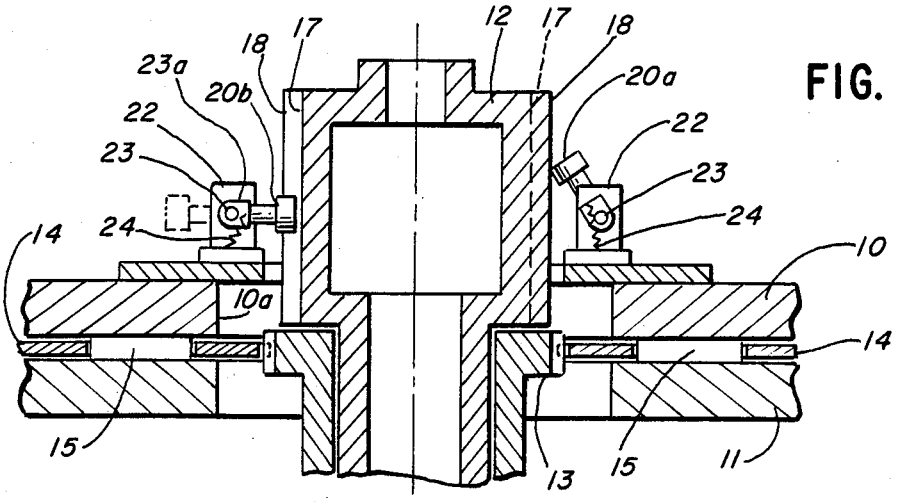
FIG. 1 is a partial sectional view of an upper plate driving system embodying the invention.
Figure 2:
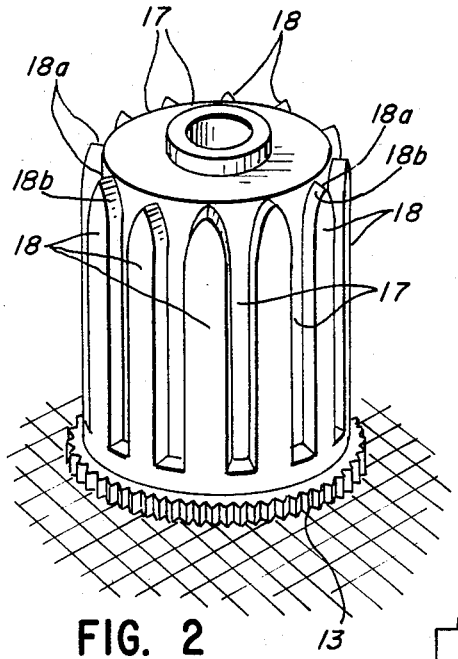
FIG. 2 is a perspective view of the upper plate driver of FIG. 1.
Figure 3:
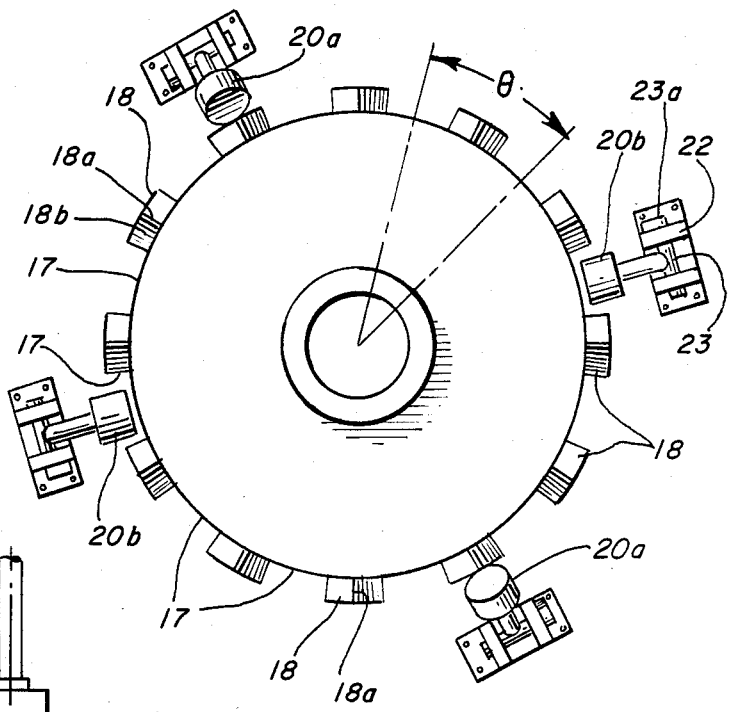
FIG. 3 is a plan view of the upper plate driving system of FIG. 1, showing the positional relation between driver slots and upper plate arms.

Referring to FIGS. 1–3, the vertical sectional view of FIG. 1 illustrates a grinding section of a surface lapping machine, wherein four elements, namely an upper plate 10, a lower plate 11, a driver 12 in a center position of the aforementioned upper plate 10 and lower plate 11 for driving the upper plate 10, and a sungear 13 (plus an unillustrated ring gear). These are arranged to lap workpieces 15 held in carriers 14, which are geared with the aforementioned ring gear and sungear 13 with the upper plate 10 and the lower plate 11 by a means for driving such as motors and the like in the same way as a well-known lapping machine.

As shown in FIGS. 2 and 3, numerous driver slots 17 are mounted on the cylindrical driver 12 circumferentially from top to bottom at a constant angle of separation from each other. The upper portions of slot guides 18 between the adjoining driver slots are machined to taper in and meet at top centers 18*a*, so that slots 17 flare outwardly.

On the other hand, a plurality of upper plate lock arms 20*a*, 20*a*, 20*b*, 20*b* are mounted on the upper plate 10 around a bore 10*a*, employing rollers removably secured in the aforementioned driver slots 17.

These upper plate locks 20*a*, 20*b* are rotatably mounted on lock arm swing center shafts 23 supported with lock mounting brackets 22 within a flat surface including the axis of the driver 12 and directed to the driver 12 by springs 24. Springs 24 are connected between lock arm pivot bases 23*a* at the end of the lock arm swing center shaft 23 and the lock mounting brackets 22, to allow rotation into engaged position with slot 17 as illustrated in the left side of FIG. 1 of the drawing. The same structure is shown in nonengaged position by two-dot chain lines.

The upper plate lock arms are divided into two groups 20*a*, 20*a*, 20*b*, 20*b*, wherein each group is respectively located at a fixed degree angle of an integer times the spacing angle between the driver slots 17, while one group of lock arms is offset from the other by half a pitch, where one pitch equals the angular distance between one driver slot and the adjacent driver slot.

That is, each group of the upper plate lock arms 20*a*, 20*b* are arranged so that one group of lock arms 20*a* or 20*b* may be always positioned substantially above the driver slots 17, while the other group 20*b* of 20*a* may be positioned above the slot guides 18.

The system of FIG. 1 functions as follows: when the upper plate 10 is lowered to the lapping position to lap the workpieces 15 by means of the aforementioned lapping machine, one group of lock arms 20*a*, or 20*b*, mounted on the upper plate 10, will be engaged into the driver slots 17, thus locking the upper plate 10 to upper plate driver 12.

In other words, even if the upper plate 10 descends in such a condition that one group of the upper plate lock arms 20*a*, 20*a* is just above the slot guides 18, the other group 20*b* will be above the driver slots 17 because of the angular offset between the two groups of upper plate lock arms by half a pitch, as defined above. Then, the second group of lock arms will be dropped into place into driver slots 17 as illustrated in the left side of FIG. 1, while the first group will be out of position, resting on slot guide 18 as illustrated in the right side of FIG. 1.

When the upper plate 10 descends in such a way that both groups of the upper plate lock arms are positioned away from the top portion of the slot guides 18, one of the groups 20*a*, 20*b* is spontaneously centered toward slots 17 by the slope 18*b* of the slot guides 18.

Thus, when the upper plate 10 descends, the first-reached group of upper plate lock arms 20*a*, 20*b* will be pulled into the driver slots 17 along the slopes of the slot guide 18, thus locking the upper plate 10 into locked relation with the driver. In accordance with the rotation and descent of the upper plate 10, the other group of the upper plate lock arms are also reached on the slope 18*b* of the slot guide 18, but the upper plate lock arms may be naturally rotated, to be pushed upwardly along slope 18*b* of the slot guide, out of the position on the slot guide 18 against the spring 24 tension, because of the inertial force of the rotating upper plate 10.

In this manner, the one group 20*a*, 20*b* first reached on the slots of the slot guide 18*b* is engaged into the driver slot 17, while the other group is allowed to be pushed out of position, as illustrated in FIG. 3 of the drawing.

Also, a worst case would be for both groups of the upper plate lock arms 20*a*, 20*b* to be positioned equidistantly on the slopes 18*b* of the slot guide 18. For example, one group of lock arms would descend upon the left slope of the slot guides, while the other group would descend upon the right slope of the slot guides simultaneously. In this case, one set of the springs 24 may have a higher tension of resistance than the other set, allowing one group of the upper plate lock arms to preferentially engage into the driver slot 17, driving the other group upwardly, away from slots 17.

While the preferred form of the present invention has been described, it is to be understood that modifications will be apparent to those skilled in the art without departing from the spirit of the invention.

The scope of the invention, therefore, is to be determined solely by the following claims.

That which is claimed is:

1. In an upper plate driving system for a surface lapping machine, which comprises:

said lapping machine having both an upper plate and a lower plate;

a cylindrical driver vertically mounted in a center section of said lower plate;

a plurality of driver slots uniformly distributed about the circumference of said driver, said slots being defined by a plurality of slot guides longitudinally positioned on said driver;

a plurality of lock arms firmly mounted on said upper plate and removably connected with said driver slots;

the improvement comprising: each lock arm being positioned in one of two groups of lock arms circumferentially separated by a phase angle equalling an integer times the angle of separation of said driver slots, and the lock arms of different groups having angular spacing from each other of said phase angle minus one half a pitch, where one pitch equals the angular distance between the center of a driver slot and that of an adjacent driver slot.

2. The driving system of claim 1 in which said driver slots define outwardly flaring outer ends to facilitate the receiving of said lock arms therein.

3. The driving system of claim 1 in which said lock arms define pivotable members capable of snapping into said driver slots as said plates are brought together into engagement with a workpiece, said lock arms being biased by spring means to snap into said driver slots, the spring means of one set of lock arms being stronger than the spring means of the other set of lock arms.

4. In an upper plate driving system for a surface lapping machine which comprises:

said lapping machine having an upper plate and a lower plate; a cylindrical driver vertically mounted in a center section of said lower plate;

a plurality of driver slots uniformly distributed about the circumference of said driver, said slots being defined by a plurality of slot guides longitudinally positioned on said slot driver;

a plurality of lock arms firmly mounted on said upper plate and removably connectable with said driver slots, the improvement comprising, in combination:

each lock arm being positioned in one of two groups of lock arms circumferentially separated by a phase angle equalling an integer times the angle of separation of driver slots, and the lock arms of different groups having angular spacing from each other of said phase angle minus one-half a pitch, where one pitch equals the distance between centers of adjacent driver slots, said driver slots being outwardly flared at their outer ends to facilitate receiving lock arms, said lock arms defining pivotal members capable of pivoting into and out of engagement with said slot guides, and spring means urging each lock arm into engagement with said slot guides, the spring means of one of said groups of said lock arms being stronger than the spring means of the other of said groups.

5. In an upper plate driving system for a surface lapping machine, which comprises, in combination: said lapping machine having both an upper plate and a lower plate; a driver for rotating one of said plates mounted in generally perpendicular relation in a central area of said plates; a plurality of first engaging members uniformly distributed about the circumference of said driver, and a plurality of second engaging members mounted on said one plate and removably engagable with said first engaging members, the improvement comprising, in combination: said second engaging members being positioned in two groups, the members of each group being circumferentially separated by a phase angle equalling an integer multiplied by the angle of separation of said first engaging members, and the second engaging members of different groups having an angular spacing from each other of said phase angle minus one-half a pitch, where one pitch equals the distance between adjacent respective first engaging members.

* * * * *